United States Patent [19]

Eberhart et al.

[11] Patent Number: 4,517,716

[45] Date of Patent: May 21, 1985

[54] PRIMER POCKETING METHOD FOR BRASS CARTRIDGE CASES

[75] Inventors: Gerald E. Eberhart, Bethalto; Goah T. Sauls, Cottage Hills, both of Ill.

[73] Assignee: Olin Corporation, Stamford, Conn.

[21] Appl. No.: 462,627

[22] Filed: Jan. 31, 1983

[51] Int. Cl.[3] ..... B21D 51/54; B21K 21/06

[52] U.S. Cl. ..... 29/1.3; 29/1.2; 29/1.31; 29/1.32

[58] Field of Search ..... 29/1.3, 1.31, 1.32; 86/10, 12; 29/1.2, 1.21, 1.22, 1.23

[56] References Cited

U.S. PATENT DOCUMENTS

| | | | |
|---|---|---|---|
| 2,388,370 | 6/1945 | Snell | 29/1.3 |
| 3,061,908 | 11/1962 | Duffield | 29/13 |
| 3,138,257 | 6/1964 | Andersen | 29/1.3 |
| 3,363,296 | 1/1968 | Duffield | 29/1.3 |
| 3,706,118 | 12/1972 | Hilton et al. | 29/1.3 |

*Primary Examiner*—Mark Rosenbaum
*Assistant Examiner*—Steven Nichols
*Attorney, Agent, or Firm*—Bruce E. Burdick

[57] ABSTRACT

A primer pocketing method in which the pocket is formed by punching through a centrally unsupported base of a cartridge blank. A funnel-shaped partially flared primer pocket is produced.

4 Claims, 2 Drawing Figures

PRIMER POCKETING METHOD FOR BRASS CARTRIDGE CASES

BACKGROUND AND SUMMARY OF THE INVENTION

This invention relates to the heading of cartridge cases.

In the manufacture of ammunition cartridge cases, cupped blanks are initially formed from a suitable metallic blank of brass by cupping and drawing operations. Such an operation is specifically detailed in U.S. Pat. No. 2,630,916, which produces a cylindrical tube having a relatively thick bottom and a relatively thin side wall. These drawn cup blanks are subsequently subjected to a series of individual operations which form a finished head on the end of the case, and if desired, a tapered neck and mouth portion on the opposite end. Such a series of forming operations is specifically detailed in U.S. Pat. No. 3,061,908, issued Nov. 6, 1962, to A. J. Duffield for "Metal Forming" incorporated by reference herein as if set forth at length.

Heretofore, various methods called "heading" have been employed in performing the work upon the closed end of the cartridge case. One method employed in the heading of cartridge cases involves the working of the metal at the closed end of the cupped blank by impact flattening and outwardly displacing the metal in the formation of a radial flange about the head. The operation simultaneously forms a closed pocket for a primer. The shaped blank is then subjected to a trimming operation which trims the flange to its ultimate dimensions. The final working of the head includes a separate and individual step of piercing a flash hole through the base of the primer pocket.

Still another prior method of forming a metal cartridge case consists of two steps. First, a flange forming operation in which the metal displaced by the punch is forced outwardly to increase the diameter of the head (any excess flange material may be removed by trimming); and second, the primer pocket and flash hole are separately formed by drilling and reaming operations.

Heretofore, the methods and machines employed in the pocketing operations were of extremely complex and intricate nature, as for example, the machine disclosed in U.S. Pat. No. 3,061,908, which uses a multiple step, closely supported punching operation.

It is apparent that heretofore, regardless of the specific methods and case structures used, the forming of cartridge cases required a number of operations and elaborate machinery to form the primer pocket and the flash hole. In addition, the use of such elaborate machinery requires maintenance and painstaking readjustments in order to accurately perform and control the various operations of heading the cartridge case.

Accordingly, it is the object of the present invention to provide a novel method and apparatus of reduced complexity for forming the primer pocket in the heads of cartridge cases and eliminating internal drilling and reaming operations.

Still another object is to provide a novel method and apparatus for forming the heads of cartridge cases while simultaneously forming a fully finished pocket in the head of the cartridge case.

Other objects and advantages will be apparent in the following description and drawing depicting a partial and sectional plane view of a structure which illustrates an embodiment of this invention.

The invention provides a method of forming a primer pocket in a metallic cartridge case which comprises the step of holding a metallic cupped rough-shaped blank with the center portion of the inside of the base unsupported while forcing an external punch a sufficient distance partially through the base of the blank at a pressure sufficient to form a pocket and cause the base of the pocket to separate to produce a finished primer pocket. The punched hole is preferably partly punched and partly torn so that the wall of the primer pocket has a funnel shape toward the inside of the case. Preferably the rim and the other portions of the head are formed simultaneously with the pocket at a single station.

The invention also provides a new shell case structure (as a result of the new pocket forming method) which comprises a metallic shell case with a partially flared funnel-shaped primer pocket.

BRIEF DESCRIPTION OF THE DRAWINGS

The invention will be better understood by reference to the attached exemplary drawing of the preferred embodiment. In the drawing.

DETAILED DESCRIPTION OF THE PREFERRED EMBODIMENTS

Details of a specific forming machine which could be utilized to perform the method of the invention after certain modifications described below is that shown in U.S. Pat. No. 3,061,908 incorporated above. The '908 patent shows a 6-station forming operation, which appear in the FIGURE of the '908 patent in order from top to bottom. Of these steps, the present invention allows the third (primer pocket forming) and fifth (flash hole forming) stations to be omitted, such operations being combined into the fourth (rim forming) station. Also, the tip of supporting pin 14 of the '908 patent would be enlarged to receive a metal chip as described below. That is, the present invention advantageously eliminates separate pocketing, drill and ream and flash hole reaming operations. This can be accomplished because of the way in which the pocketing is done which surprisingly eliminates drilling, eliminates reaming and eliminates the flash hole. In fact, instead of a flash hole (i.e., hole of greatly decreased diameter) the present method produces a cartridge case having an increased internal diameter where the flash hole would normally be expected.

Figure 1:
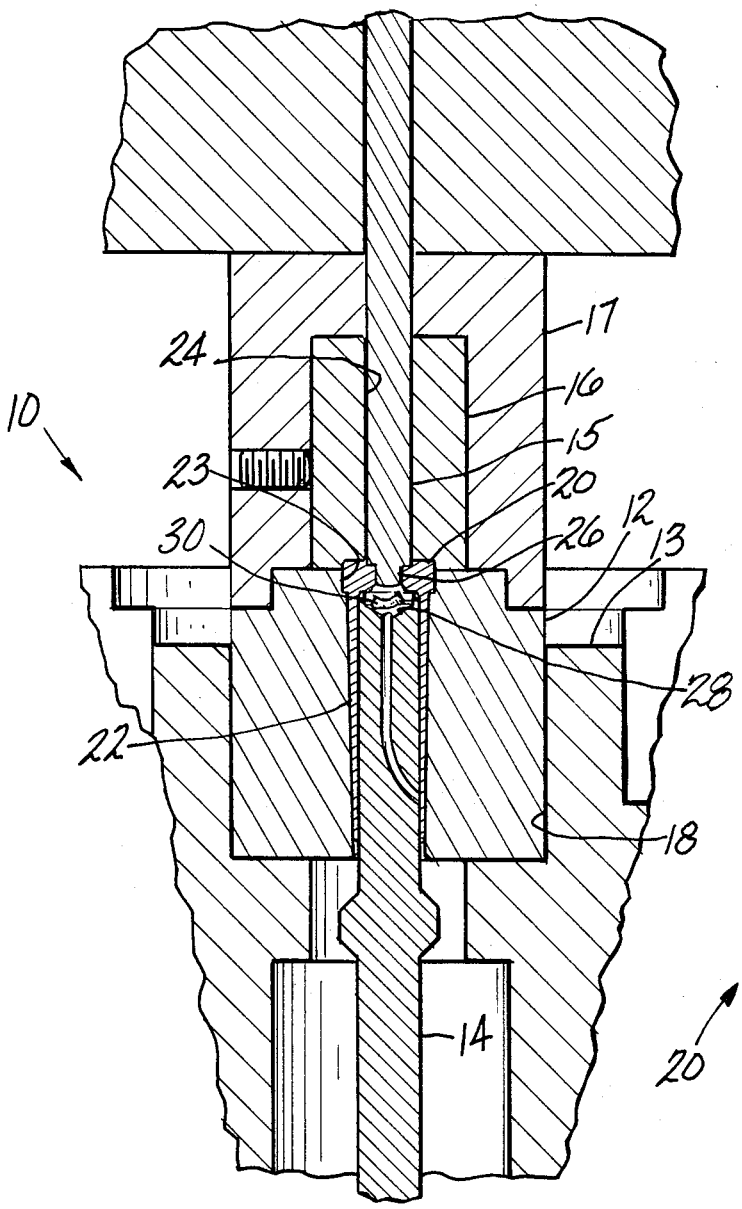
FIG. 1 is a top cross-sectional view taken along the horizontal axis of the pocket forming station of a case forming tool with cartridge case immediately after pocket forming.
Figure 2:
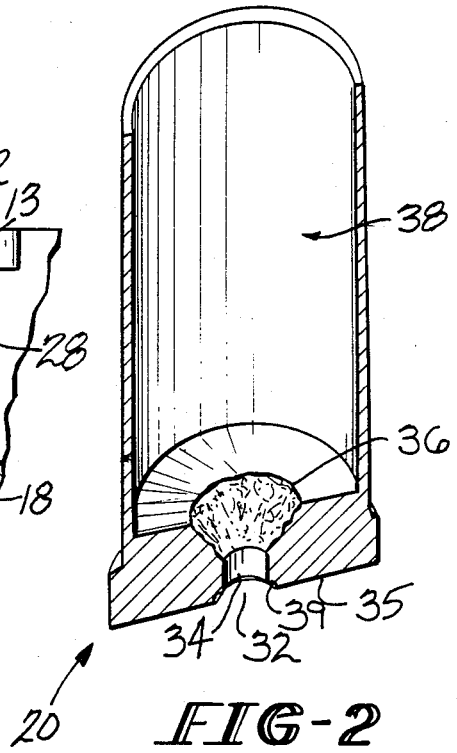
FIG. 2 is a diametrical axial cross-sectional view through a shell case of the invention showing the funnel shaped primer pocket.

The primer pocket is formed by a single punching operation. The mechanism for this operation is shown in FIG. 1. The mechanism 10 of FIG. 1 is used to form a shell case 20 as seen in FIG. 2. The mechanism 10 would be a part of a multi-station case forming machine such as that shown in U.S. Pat. No. 3,061,908 although the number of stations would be reduced as a result of the invention.

Referring to FIG. 1, mechanism 10 comprises a heading die 12, a die support 13, a heading punch 14, a heading bunter pin 15, a heading bunter 16, a bunter support 17, a bunter mover (not shown), a bunter pin mover (not shown), a heading punch mover (not shown), and a controller (not shown).

Die 12 is a tubular cylindrical hardened steel metal forming die having a stepped tapered axial bore therethrough of a shape conforming to the desired external wall of the formed shell 20. This bore 22 in cooperation with the outer wall of punch 14 positions the wall of shell 20. The steps 23 in bore 22 is shaped so as to form the rim at the base of the shell. Die 12, punch 14, pin 15, and bunter 16 are all oriented with their axis horizontal, although other orientations would work so long as the metal chip below described could be removed and would not interfere with other subsequent operations. Die 12 is held within a cylindrical recess 18 of die support 13 and prevented from moving relative thereto. Die 12 has a stepped outer surface adapted to receive a correspondingly stepped end of bunter support 17, although this stepped relationship could be deleted if desired. Bunter support 17 is a cylindrical cup-shaped member which holds bunter 16 therewithin. Bunter 16 is, in turn, a tubular right cylindrical steel body with a stepped bore 24 therethrough. Bore 24 is sized so as to receive pin 15 slidingly therethrough. Pin 15 is a solid cylindrical member with a pocketing projection 26 at its tip end. Projection 26 is preferably of a length slightly less than the axial thickness of the base of shell 20, for reasons below described.

Punch 14 is a cylindrical steel member with an inverted frustoconical end portion or hollow point 28 adapted to receive a metal chip 30. This metal chip 30 is that portion of the base portion of shell 20 which is not punched but is rather torn lose from the remainder of the base portion of shell 20 due to the forces imposed by projection 26 upon the base portion. Applicant has found that a projection such as projection 26 will form only partway through an unsupported base portion of a shell 20 and that the remainder of the base portion will fail due to the remainder of the base portion being stressed past its ultimate tensile strength. It is for this reason that the projection 26 need not have an axial length equal to the axial thickness of the base portion of shell 20 and yet can form a hole therethrough which is satisfactory for a primer pocket. To those of skill in the art, it will be appreciated that the funnel shape of this hole is contrary to the design typically used as a primer pocket in brass cartridge cases. Specifically, the normal primer pocket in a brass centerfire cartridge case is an axial pocket extending partly, but not fully, through the base of the cartridge case and a much smaller diameter hole ("flash hole") through the remainder of the base of the shell. This reduced diameter flash hole has been considered necessary for proper ignition of the propellant charge to be loaded into the ultimate loaded round incorporating the cartridge case. Applicant has recognized the fact that shotshells conventionally utilize a different type of primer than do conventional centerfire cartridges. The conventional shotshell primer incorporates a flash hole as an integral part thereof. Therefore, applicant has recognized that a brass shotshell case need not have a flash hole such as found in most other brass centerfire cases.

However, applicant has gone a step further and additionally realized that the primer pocket can even have a flared inner end in the case of shotshells and yet achieve satisfactory performance.

Referring now to FIG. 2, this funnel-shaped primer pocket 32 is seen to comprise a smooth cylindrical portion 34 opening to the rear 35 of the case 20 and a rough frustoconical forwardly flared portion 36 connecting portion 34 to the interior cavity 38 of the case 20. Portion 34 is also preferably stepped or rearwardly flared slightly to produce a step 39 adapted to receive a flanged primer cup such as the typical 209 shotshell primer. The case is preferably of cartridge brass such as that produced by Olin Corporation at East Alton, Illinois.

An unexpected advantage of this invention is that the inside end of the primer cup expands to conform to the flared inner wall of the primer pocket much like a rivet thus virtually eliminating the possibility of the primer being forced rearwardly out of the shell during firing.

What is claimed is:

1. A method of forming a primer pocket in a metallic cupped cartridge case blank which method comprises the steps of:

a. holding the blank with one side of the base unsupported while simultaneously b. forcing a punch a sufficient distance partially through the base of the blank from the side opposite said one side with a pressure sufficient to cause the remaining unpunched portion of the base to separate to produce a primer pocket passing completely through said base.

2. The method of claim 1 further comprising the step of:

forming a rim on said blank by pressing said blank against a rim forming die simultaneous with said punch forcing step.

3. The method of Step 2 further comprising the step of:

a. catching a metallic chip, produced by said punch forcing step, in a cavity of a die punch; and b. depositing said chip loosely in said shell as said shell is removed from the mechanism used to form the primer pocket.

4. The method of claim 3 wherein said blank is held with its axis horizontal so that said chip is left loosely within said shell upon said shell removal.

* * * * *